US012157201B2

(12) United States Patent
Chuang

(10) Patent No.: US 12,157,201 B2
(45) Date of Patent: Dec. 3, 2024

(54) OSCILLATING DEVICE OF BELT SANDER

(71) Applicant: Bor-Yann Chuang, Taichung (TW)

(72) Inventor: Bor-Yann Chuang, Taichung (TW)

( * ) Notice: Subject to any disclaimer, the term of this patent is extended or adjusted under 35 U.S.C. 154(b) by 544 days.

(21) Appl. No.: 17/542,404

(22) Filed: Dec. 4, 2021

(65) Prior Publication Data

US 2023/0173635 A1 Jun. 8, 2023

(51) Int. Cl.

| | |
|---|---|
| ***B24B 21/22*** | (2006.01) |
| ***B24B 21/10*** | (2006.01) |
| ***B24B 21/20*** | (2006.01) |
| ***B24B 23/06*** | (2006.01) |
| ***B24B 27/02*** | (2006.01) |

(52) U.S. Cl.

CPC ..... *B24B 21/22* (2013.01); *B24B 21/10* (2013.01); *B24B 21/20* (2013.01); *B24B 23/06* (2013.01); *B24B 27/02* (2013.01)

(58) Field of Classification Search

CPC ..... B24B 21/00; B24B 21/10; B24B 21/20; B24B 21/22; B24B 27/02; B24B 23/04; B24B 23/06; B24B 47/02; B24B 47/04; B24B 41/0475

USPC ..... 451/59, 297, 299, 304, 355

See application file for complete search history.

(56) References Cited

U.S. PATENT DOCUMENTS

| | | | | |
|---|---|---|---|---|
| 2,747,342 | A * | 5/1956 | Ritter | B24B 21/002 451/121 |
| 2,926,465 | A * | 3/1960 | Sommers | B24B 21/18 451/304 |
| 3,354,588 | A * | 11/1967 | Roehrig | B24B 21/18 451/311 |
| 3,447,306 | A * | 6/1969 | Zigmant | B24B 21/18 137/83 |
| 3,577,684 | A * | 5/1971 | Jakimcius | B24B 21/18 451/311 |
| 4,651,474 | A * | 3/1987 | David | B24B 21/22 451/300 |
| 6,722,966 | B1 * | 4/2004 | Wang | B24B 21/22 451/310 |
| 8,574,036 | B2 * | 11/2013 | Weiland | B24B 9/002 451/309 |
| 2004/0087260 | A1 * | 5/2004 | Wang | B24B 21/12 451/296 |
| 2009/0142992 | A1 * | 6/2009 | Takahashi | B24B 41/068 451/36 |

* cited by examiner

*Primary Examiner* — Eileen P Morgan
(74) *Attorney, Agent, or Firm* — PAI PATENT & TRADEMARK LAW FIRM; Chao-Chang David Pai

(57) ABSTRACT

An oscillating device of a belt sander is disclosed. The belt sander includes a base, a rotating unit, an oscillating unit, and a control unit. The rotating unit is disposed on one side of the base. The rotating unit includes a motor and a roller. The oscillating unit is disposed on the other side of the base. The oscillating member includes a rolling wheel and an electric motor. The motor and the electric motor drive the roller and the rolling wheel to rotate, and the control unit controls the oscillation frequency of the electric motor. The service life of the motor and the electric motor can be prolonged, thereby improving the working efficiency of the belt sander.

9 Claims, 12 Drawing Sheets

OSCILLATING DEVICE OF BELT SANDER

FIELD OF THE INVENTION

The present invention relates to an oscillating device, and more particularly to an oscillating device of a belt sander.

BACKGROUND OF THE INVENTION

A conventional belt sander includes a base. A driving roller and a driven roller are pivotedly connected to both ends of the base. The driving roller is connected to a motor. An abrasive belt is fitted on the outer peripheries of the driving roller and the driven roller. When the driving roller is driven by the motor to rotate, the abrasive belt in a tight state will be pulled. Thus, an object to be sanded is placed to be in contact with the abrasive belt for sanding.

However, in the conventional belt sander, the driving roller and the driven roller are driven by the motor to rotate. After being used for a long time, it is easy to damage the motor. The service life of the motor is shortened, which reduces the working efficiency greatly. Accordingly, the inventor of the present invention has devoted himself based on his many years of practical experiences to solve these problems.

SUMMARY OF THE INVENTION

The primary object of the present invention is to provide an oscillating device of a belt sander, which can prolong the service life of a motor of the belt sander and improve the working efficiency of the belt sander.

In order to achieve the above object, the present invention provides an oscillating device of a belt sander. The belt sander comprises a base. The base is provided with a workbench, a substrate, and a rotating unit. The rotating unit includes a motor for driving a roller to rotate. The oscillating device comprises an oscillating unit. The oscillating unit includes a rotating member and an oscillating member. The rotating member includes a frame. The frame is pivotally connected to the substrate. A rolling wheel is pivotally connected to the frame. An abrasive belt is sleeved on the rolling wheel and the roller. The oscillating member is disposed at a bottom of the substrate and connected to the rotating member. The oscillating member includes an electric motor. The electric motor is connected with a linking member through a linking shaft. The linking shaft and the linking member are arranged eccentrically. The linking member is connected to the frame.

In the oscillating device of the belt sander provided by the present invention, the motor and the electric motor drive the roller and the rolling wheel to rotate, and the control unit controls the oscillation frequency of the electric motor. The service life of the motor and the electric motor can be prolonged, thereby improving the working efficiency of the belt sander.

DETAILED DESCRIPTION OF THE PREFERRED EMBODIMENTS

Embodiments of the present invention will now be described, by way of example only, with reference to the accompanying drawings.

Figure 1:
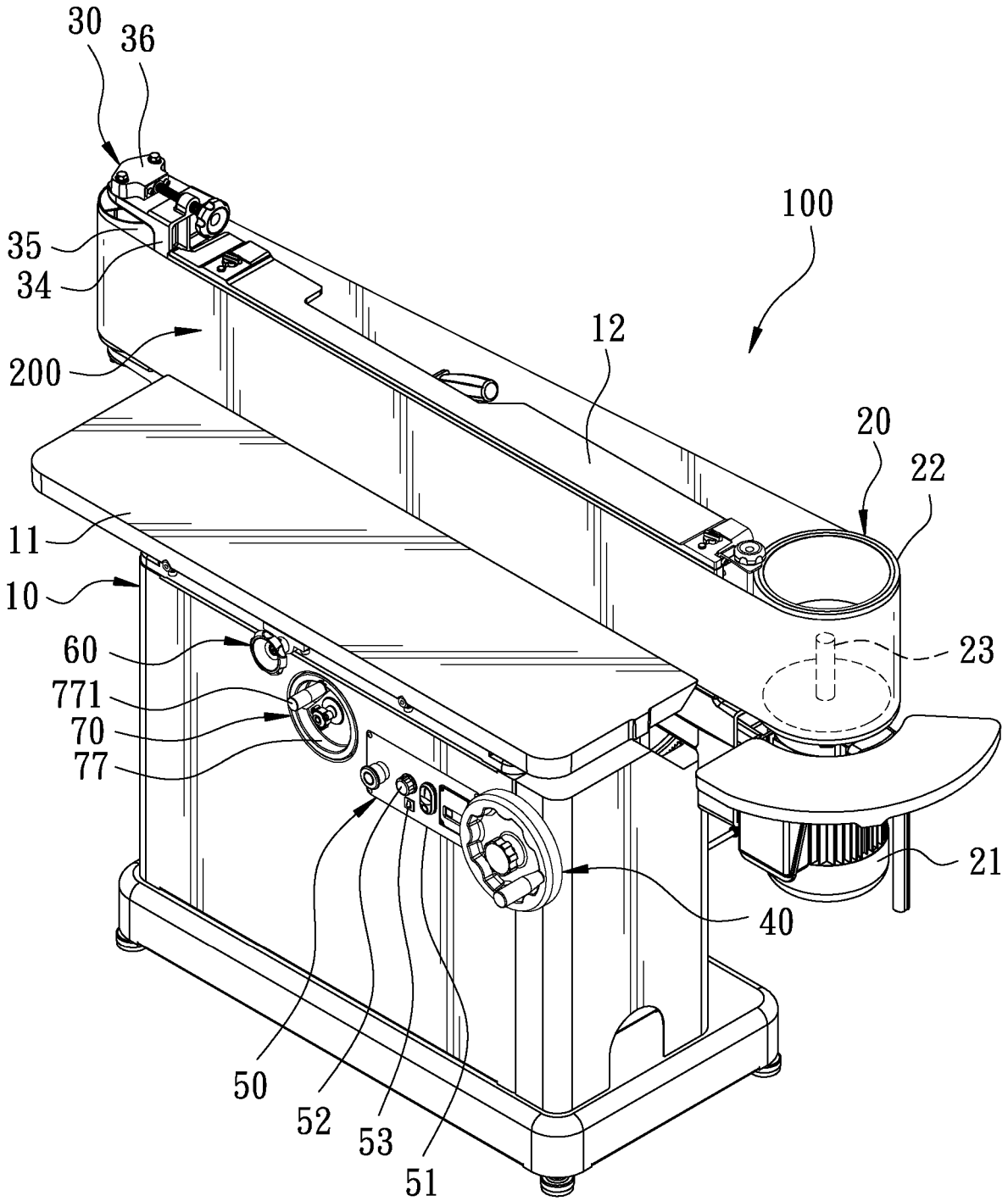
FIG. 1 is a perspective view of a preferred embodiment of the present invention.
Figure 2:
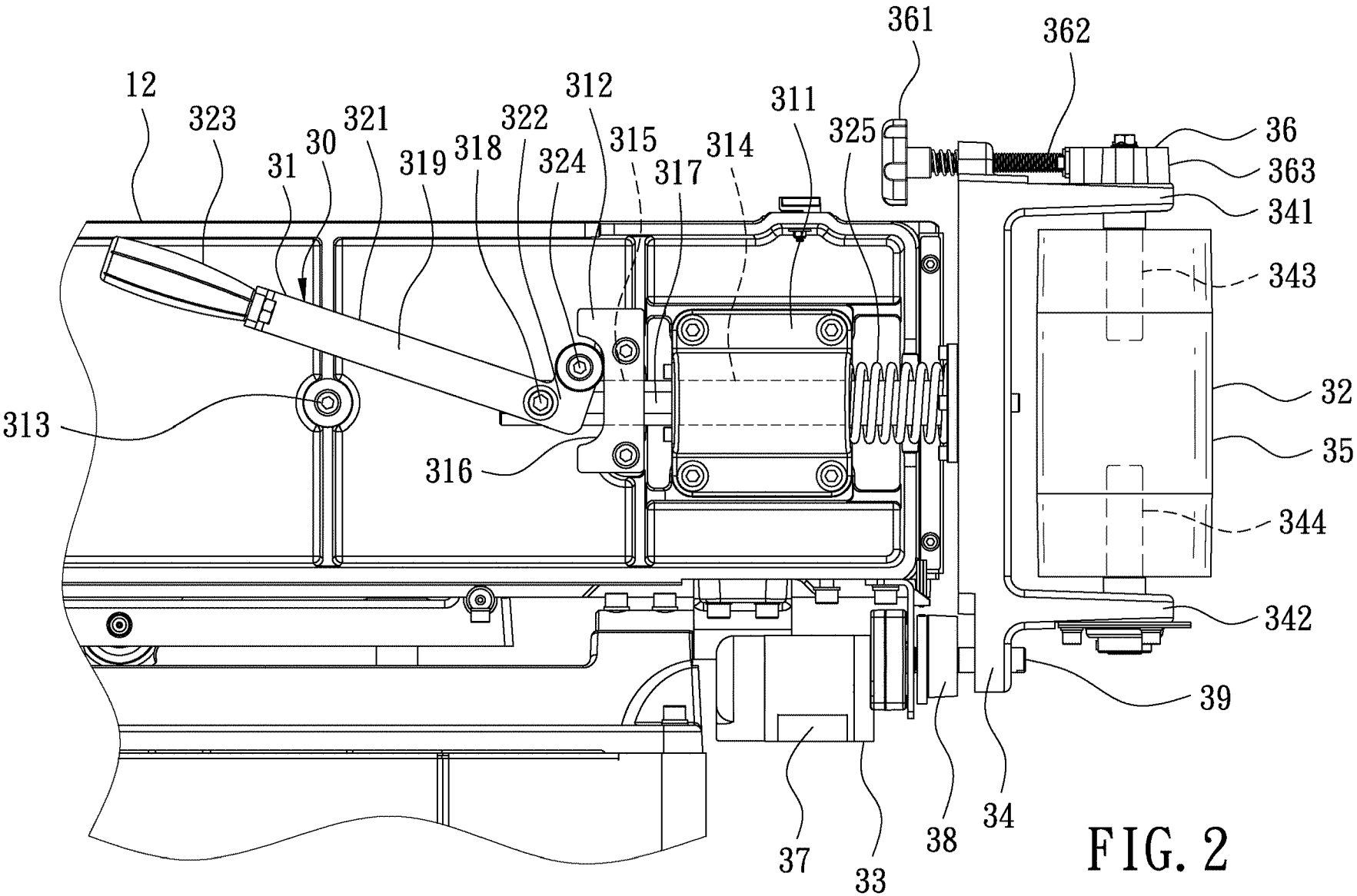
FIG. 2 is a side view of the preferred embodiment of the present invention, illustrating the oscillating device.
Figure 3:
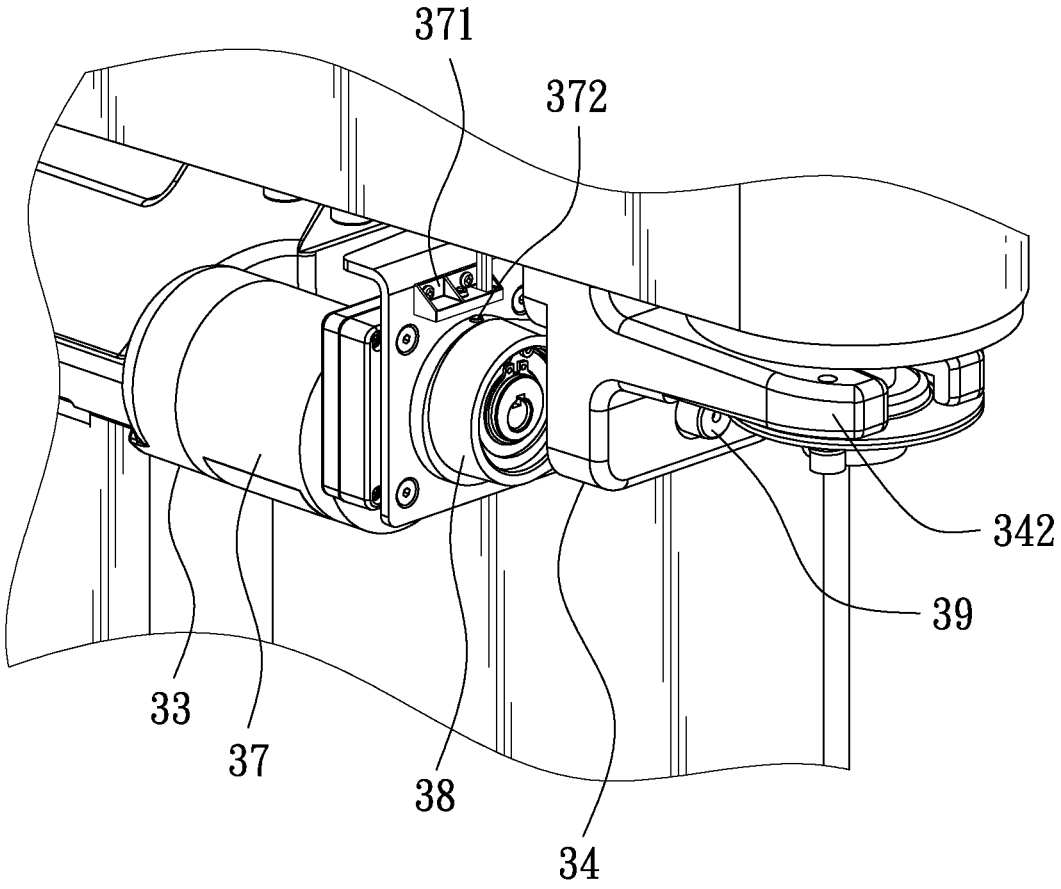
FIG. 3 is a partial perspective view of the preferred embodiment of the present invention, illustrating the oscillating device.

FIG. 1 is a perspective view of a preferred embodiment of the present invention. FIG. 2 is a side view of the preferred embodiment of the present invention. FIG. 3 is a partial perspective view of the preferred embodiment of the present invention. The present invention discloses an oscillating device of a belt sander 100. The belt sander 100 includes a base 10, a rotating unit 20, an oscillating unit 30, an angle adjustment unit 40, a control unit 50, a forward and backward adjustment unit 60, and an upward and downward adjustment unit 70.

A workbench 11 is connected to the top of the base 10. The workbench 11 is configured to place an object to be sanded. A substrate 12 is provided on one side of the workbench 11. The substrate 12 is arranged at an angle to the workbench 11.

The rotating unit 20 is disposed on one side of the base 10. The rotating unit 20 includes a motor 21 and a roller 22. The motor 21 is provided with a transmission shaft 23. One end of the transmission shaft 23 is connected to the roller 22, so that the transmission shaft 23 can drive the roller 22 to rotate when the motor 21 is running.

Figure 4:
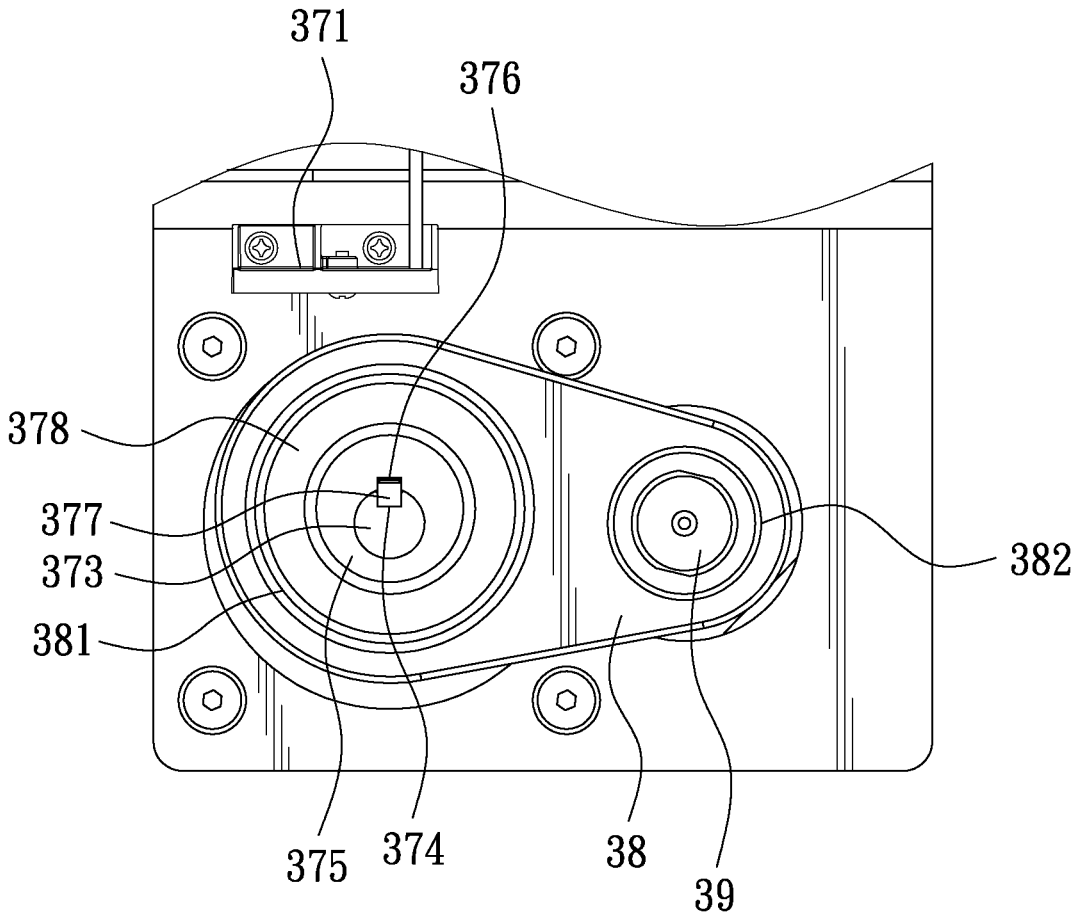
FIG. 4 is a partial side view of the preferred embodiment of the present invention, illustrating the oscillating device.

FIG. 4 is a partial side view of the preferred embodiment of the present invention. The oscillating unit 30 is disposed on the other side of the base 10. The oscillating unit 30 includes a positioning member 31, a rotating member 32, and an oscillating member 33. The positioning member 31 has a cover plate 311. One side of the cover plate 311 is provided with a limiting block 312 and a retaining rod 313. The cover plate 311, the limiting block 312 and the retaining rod 313 are fixed to the substrate 12, respectively. The cover plate 311 has a through hole 314. A perforation 315 is formed between the limiting block 312 and the substrate 12. One side of the limiting block 312, close to the retaining rod 313, is formed with a limiting groove 316. In the embodiment of the present invention, the limiting groove 316 is a U-shaped groove. A shaft 317 is inserted in the through hole 314 and the perforation 315. One end of the shaft 317, close to the limiting block 312, extends outwardly and is pivotally connected to a pivot plate 319 through a pivot member 318. The pivot plate 319 is generally L-shaped and has a driving portion 321 and a driven portion 322 that are perpendicular to each other. The length of the driving portion 321 is greater than the length of the driven portion 322. The driving portion 321 of the pivot plate 319 is close to the retaining rod 313 and can be blocked by the retaining rod 313. The free end of the driving portion 321 of the pivot plate 319 is connected to a handle 323 which can be held by the user. The free end of the driven portion 322 of the pivot plate 319 is pivotally connected to a pivot wheel 324. The pivot wheel 324 is movably disposed in the limiting groove 316. The other end of the shaft 317, opposite to the handle 323, extends out of the substrate 12 and is pivotally connected to the rotating member 32. The shaft 317 is sleeved with an elastic member 325 between the cover plate 311 and the rotating member 32. The rotating member 32 includes a frame 34, a rolling wheel 35, and an adjusting member 36. The frame 34 is generally U-shaped. The frame 34 is connected to the shaft 317. The frame 34 has a first end 341 and an opposing second end 342. The first end 341 is provided with a first rotating shaft 343. The second end 342 is provided with a second rotating shaft 344. The first rotating shaft 343 and the second rotating shaft 344 are insertedly connected to the rolling wheel 35. An abrasive belt 200 is fitted on the outer periphery of the rolling wheel 35 and the outer periphery of the roller 22. The rotating member 32 is connected with the adjusting member 36 at the first end 341. The adjusting member 36 includes a screw cap 361, an adjusting rod 362, and a positioning block 363. The adjusting rod 362 is disposed between the screw cap 361 and the positioning block 363. The positioning block 363 is connected to the first rotating shaft 343. The oscillating member 33 is disposed at the bottom of the substrate 12 and connected to the rotating member 32. The oscillating member 33 includes an electric motor 37 and a linking member 38. The electric motor 37 is electrically connected to a sensor 371. A positioning magnet 372 is provided below the sensor 371. The positioning magnet 372 is attached to the linking member 38 and can be rotated synchronously with the linking member 38. The transmission shaft of the electric motor 37 is connected to a linking shaft 373 through a deceleration mechanism. The free end of the linking shaft 373 is formed with a receiving groove 374. The linking shaft 373 is connected to the linking member 38. The linking member 38 is a seat, and has a receiving hole 381 and an axial hole 382 that are spaced apart from each other. The free end of the linking shaft 373 is located in the receiving hole 381 and is sleeved with an eccentric wheel 375. The linking shaft 373 and the eccentric wheel 375 are arranged eccentrically. The eccentric wheel 375 has an accommodating groove 376 corresponding to the receiving groove 374. A pin 377 is inserted in the receiving groove 374 and the accommodating groove 376. The eccentric wheel 375 is sleeved with a bearing 378. The bearing 378 and the eccentric wheel 375 are disposed in the receiving hole 381. The bearing 378, the eccentric wheel 375 and the receiving hole 381 are arranged concentrically. An eccentric shaft 39 passes through the axial hole 382. The eccentric shaft 39 is connected to the second end 342 of the frame 34.

Figure 5:
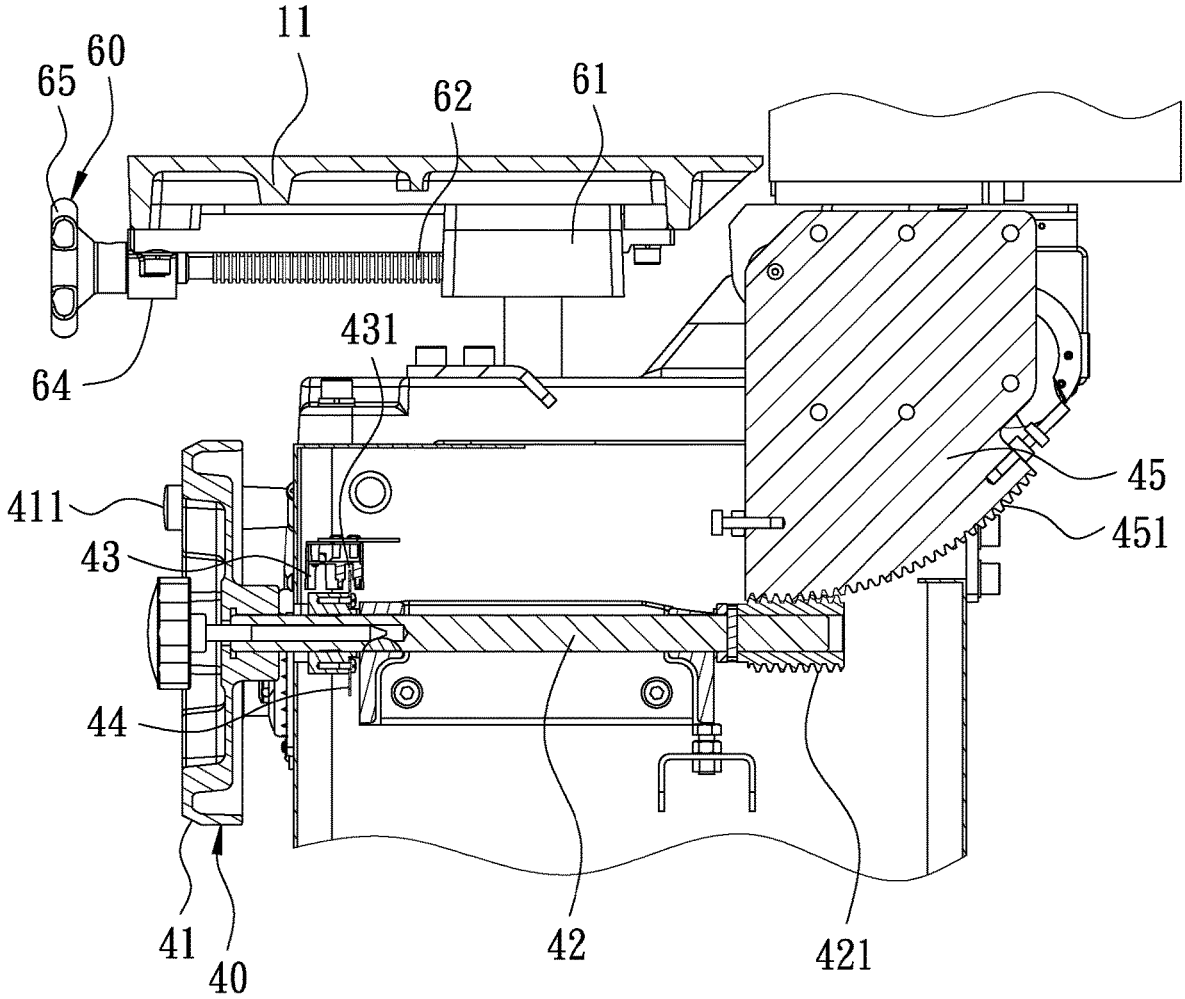
FIG. 5 is a partial cross-sectional view of the preferred embodiment of the present invention, illustrating the angle adjustment unit.

FIG. 5 is a partial cross-sectional view of the preferred embodiment of the present invention. The angle adjustment unit 40 is disposed on the base 10 close to one side of the rotating unit 20. The angle adjustment unit 40 includes an angle adjustment member 41. An angle adjustment handle 411 is provided on one side of the angle adjustment member 41. The angle adjustment handle 411 is configured for the user to hold thereon. The other side of the angle adjustment member 41 is connected to a connecting rod 42. The connecting rod 42 is sleeved with a detecting member 43 and a scale ring 44. The detecting member 43 has a recess 431 for detecting the rotation angle of the scale ring 44. The other end of the connecting rod 42 has a threaded portion 421. An adjusting plate 45 is connected to the threaded portion 421. The adjusting plate 45 has a curved toothed portion 451 corresponding to the threaded portion 421. The toothed portion 451 is engaged with the threaded portion 421. One end of the adjusting plate 45, opposite to the toothed portion 451, is secured to the substrate 12.

Figure 6:
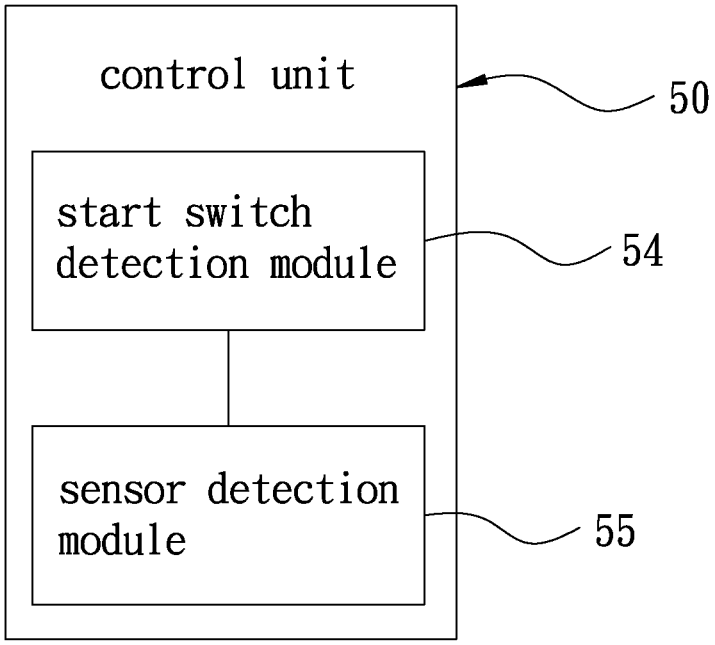
FIG. 6 is a block diagram of the system of the control unit of the preferred embodiment of the present invention.

FIG. 6 is a block diagram of the control unit of the preferred embodiment of the present invention. The control unit 50 is disposed on the base 10. The control unit 50 has a panel 51, a knob 52, and a switch 53. The panel 51 is configured to display the angle value generated by the angle adjustment unit 40. The knob 52 is configured to adjust the speed of the electric motor 37. The switch 53 is configured to turn on/off the belt sander 100. The control unit 50 includes a start switch detection module 54 and a sensor detection module 55. The start switch detection module 54 is configured to detect whether the knob 52 is reset to zero. The sensor detection module 55 is configured to detect whether the positioning magnet 372 is positioned at a predetermined position.

Figure 7:
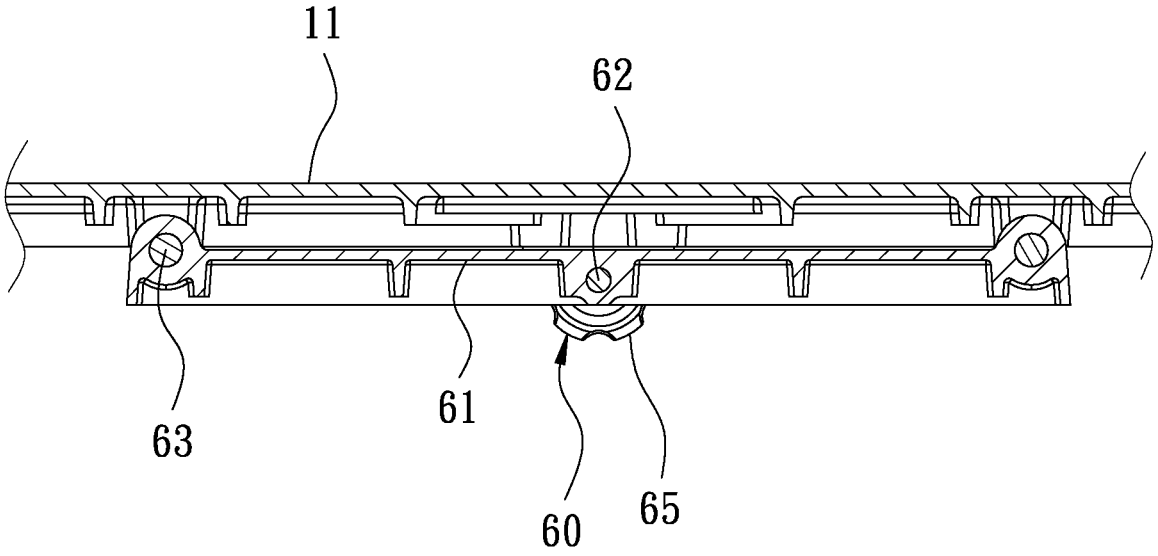
FIG. 7 is a partial cross-sectional view of the preferred embodiment of the present invention, illustrating the workbench and the forward and backward adjustment unit.

FIG. 7 is a partial cross-sectional view of the preferred embodiment of the present invention. The forward and backward adjustment unit 60 is disposed under the workbench 11. The forward and backward adjustment unit 60 includes a retaining seat 61. The retaining seat 61 parallel to the workbench 11 is threadedly connected with a screw rod 62 and two positioning posts 63. The other end of the screw rod 62 extends outwardly and is inserted through a limiting member 64 of the workbench 11. The free end of the screw rod 62 is connected to a forward and backward adjustment knob 65. Two ends of the positioning posts 63 are respectively secured to the workbench 11, so that the workbench 11 can move back and forth along the long axis of the positioning posts 63.

Figure 8:
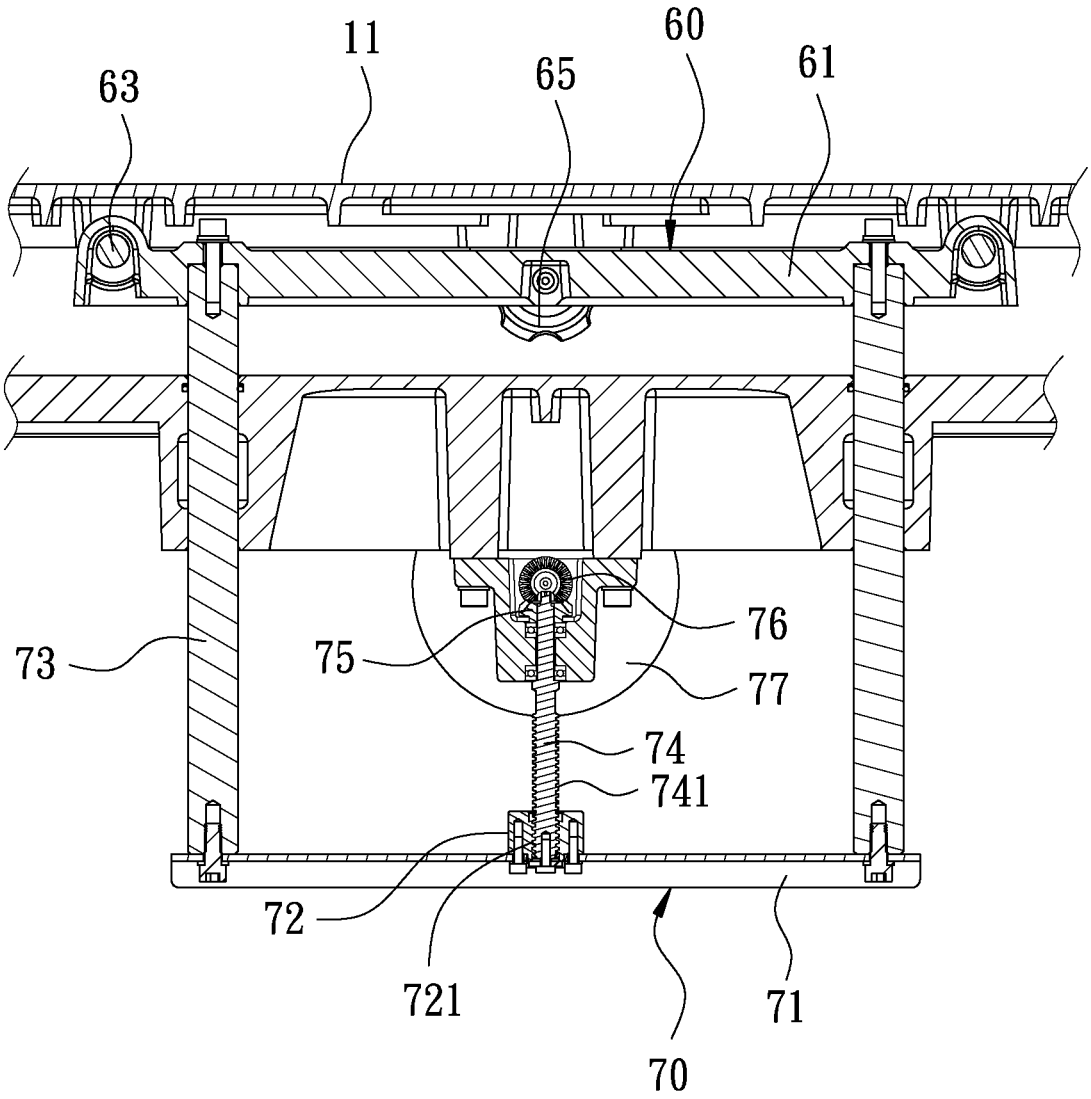
FIG. 8 is a partial cross-sectional view of the preferred embodiment of the present invention, illustrating the workbench and the upward and downward adjustment unit.

FIG. 8 is a partial cross-sectional view of the preferred embodiment of the present invention. The upward and downward adjustment unit 70 is disposed on the base 10. The upward and downward adjustment unit 70 includes a lifting plate 71. The top of the lifting plate 71 is provided with an upward and downward adjustment block 72 and two retaining posts 73. The upward and downward adjustment block 72 has an internal thread 721 for engagement of a threaded section 741 of a lifting rod 74. The lifting rod 74 is connected with a first gear 75. The first gear 75 is meshed with a second gear 76. The second gear 76 is perpendicular to the first gear 75. The second gear 76 is connected with a rotating member 77. The rotating member 77 is provided with a handle 771 for the user to hold thereon. One end of each retaining post 73, opposite to the lifting plate 71, is secured to the workbench 11, so that the workbench 11 can reciprocate along the long axis of the retaining post 73.

Figure 9:
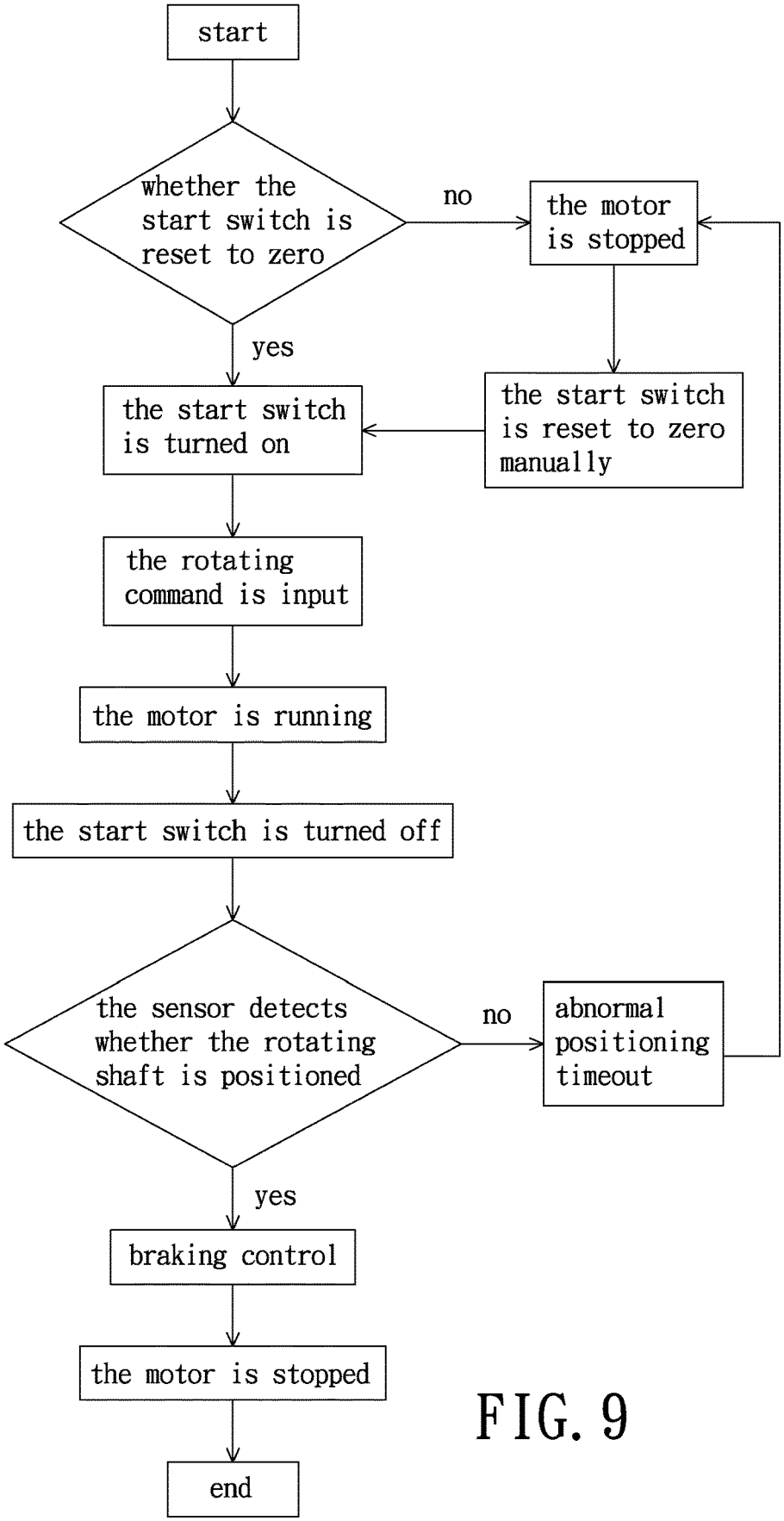
FIG. 9 is a block diagram of the control unit of the preferred embodiment of the present invention.
Figure 10:
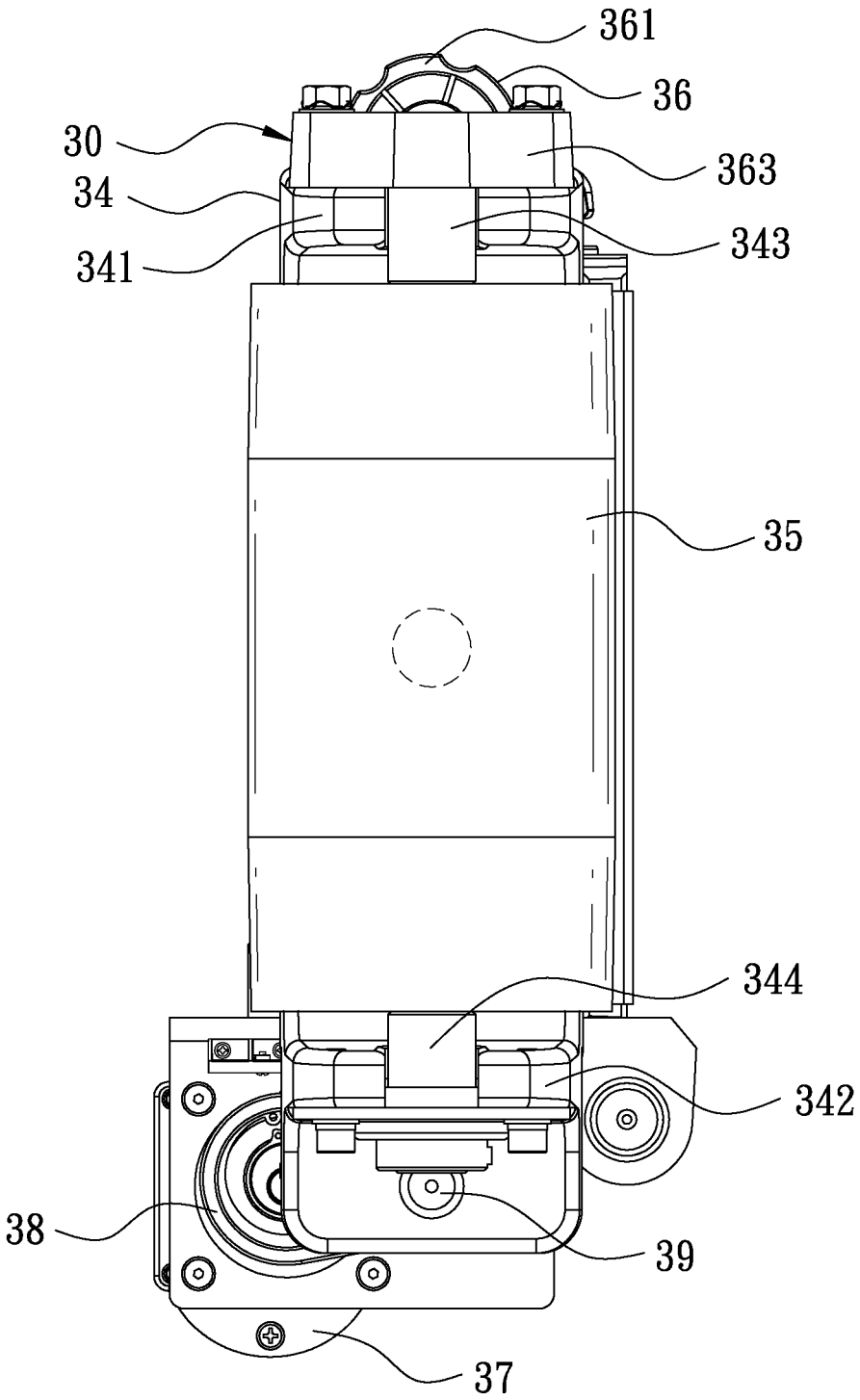
FIG. 10 is a schematic view of the preferred embodiment of the present invention when in use, illustrating the oscillation of the oscillating device.
Figure 11:
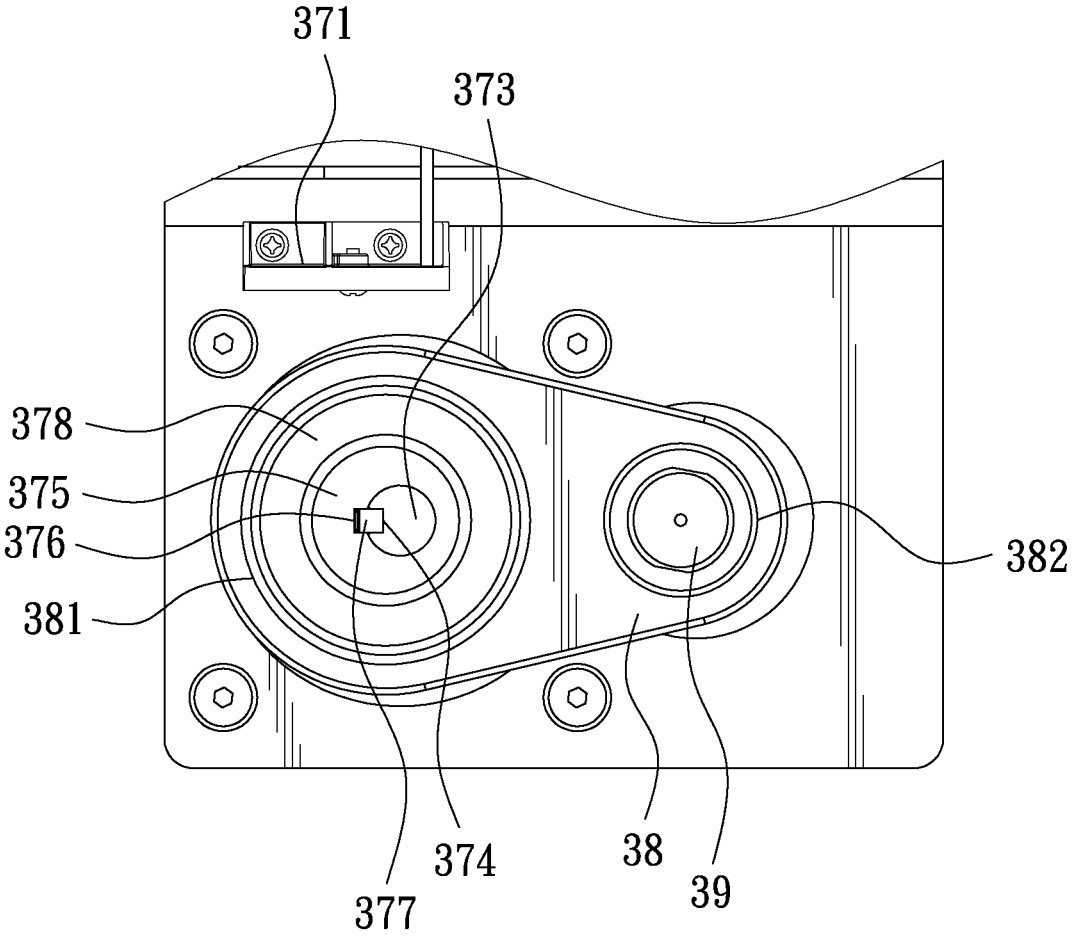
FIG. 11 is a schematic view of the preferred embodiment of the present invention when in use, illustrating the rotation of the oscillating member.
Figure 12:
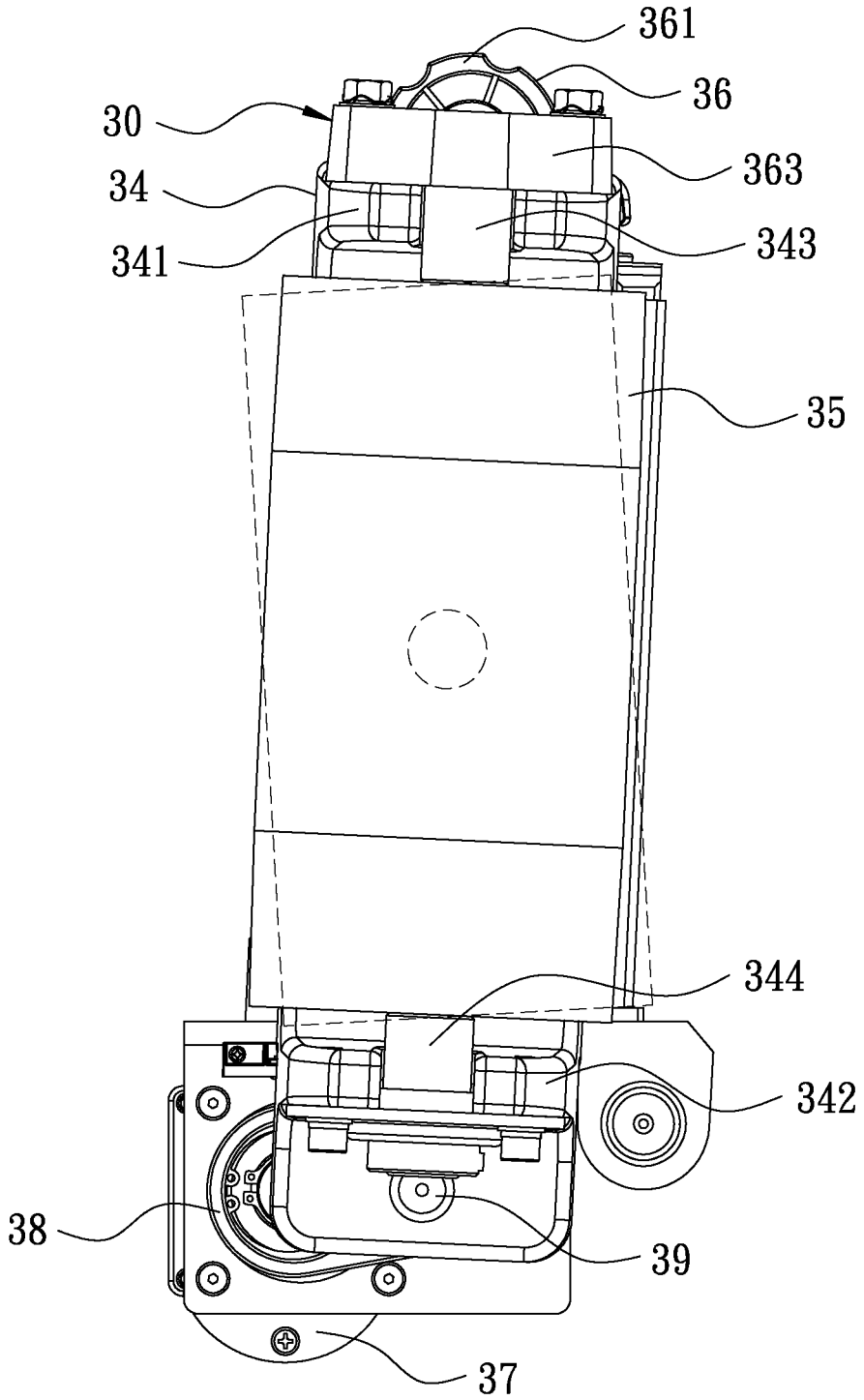
FIG. 12 is a schematic view of the preferred embodiment of the present invention when in use, illustrating the oscillation of the oscillating device.

Referring to FIG. 4 and FIG. 9, when the belt sander 100 is in use, the switch 53 is turned on first, so that the motor 21 drives the roller 22 to rotate through the transmission shaft 23, and the rolling wheel 35 is simultaneously rotated through the traction of the abrasive belt 200. At this time, the start switch detection module 54 will first detect whether the knob 52 is reset to zero. If the knob 52 is not at the zero position, the control unit 50 will control the electric motor 37 to stop running. The user needs to turn the knob 52 to the zero position. If the knob 52 is at the zero position, the user can input a rotating command for the electric motor 37 to run, so that the electric motor 37 links the linking shaft 373 to drive the linking member 38 to act. The eccentric shaft 39 is driven by the linking member 38, so that the eccentric shaft 39 drives the rolling wheel 35 to oscillate left and right through the frame 34. As shown in FIGS. 10 to 12, when the user wants to stop the electric motor 37, the sensor detection module 55 detects whether the positioning magnet 372 is located at the predetermined position through the sensor 371. The predetermined position is that the positioning magnet 372 is located right below the sensor 371. If the positioning magnet 372 is not positioned at the predetermined position, it will be determined as abnormal positioning timeout after five seconds. The control unit 50 will control the electric motor 37 to stop running. At this time, the user needs to turn the knob 52 to the zero position and operate again. If the positioning magnet 372 is positioned at the predetermined position, the control unit 50 will directly control the electric motor 37 to brake until it stops. Thereby, the oscillating device of the belt sander provided by the present invention drives the roller 22 and the rolling wheel 35 to rotate through the motor 21 and the electric motor 37. The control unit 50 controls the oscillation frequency of the electric motor 37. The service life of the motor 21 and the electric motor 37 can be prolonged, thereby improving the working efficiency of the belt sander 100.

If the abrasive belt 200 is shifted during operation of the belt sander 100, the adjusting rod 362 will be rotated to adjust the pre-force against the positioning block 363 by rotating the screw cap 361, so that the first rotating shaft 343 is forced to adjust the position of the abrasive belt 200 on the rolling wheel 35 for the abrasive belt 200 to be centered to avoid falling.

At the same time, the user can hold the handle 323 for the pivot plate 319 to drive the pivot wheel 324 to rotate, and the shaft 317 is driven by the pivot member 318 to move the frame 34, so that the distance between the roller 22 and the rolling wheel 35 can be adjusted, thereby adjusting the tightness of the abrasive belt 200.

The user can use the angle adjustment handle 411 to rotate the angle adjustment member 41, so that the connecting rod 42 drives the adjusting plate 45 to rotate, so as to drive the substrate 12 to rotate. At the same time, the detecting member 43 detects the scale rotated by the scale ring 44 and sends it back to the control unit 50, so that the panel 51 displays the angle of the substrate 12 for the user's confirmation.

The user can rotate the forward and backward adjustment knob 6 to rotate the screw rod 62 and drive the retaining seat 61, so that the workbench 11 can be moved back and forth along the long axis of the positioning post 63 to achieve the purpose of adjusting the workbench 11 back and forth.

The user can rotate the rotating member 77 through the handle 771 to drive the second gear 76 and the first gear 75 to rotate and drive the threaded section 741 of the lifting rod 74 to act. The lifting plate 71 is linked by the upward and downward adjustment block 72, so that the workbench 11 can reciprocate along the long axis of the retaining posts 73 to achieve the purpose of lifting and adjusting the workbench 11.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An oscillating device of a belt sander, the belt sander comprising a base, the base being provided with a workbench, a substrate and a rotating unit, the rotating unit including a motor for driving a roller to rotate, the oscillating device comprising:

an oscillating unit, including a rotating member and an oscillating member, the rotating member including a frame, the frame being pivotally connected to the substrate, a rolling wheel being pivotally connected to the frame, an abrasive belt being sleeved on the rolling wheel and the roller, the oscillating member being disposed at a bottom of the substrate and connected to the rotating member, the oscillating member including an electric motor, the electric motor being connected with a linking member through a linking shaft, the linking shaft and the linking member being arranged eccentrically, the linking member being connected to the frame, wherein the oscillating unit further includes a positioning member, the positioning member has a cover plate, one side of the cover plate is provided with a limiting block and a retaining rod, the cover plate, the limiting block and the retaining rod are respectively fixed to the substrate, the cover plate has a through hole, a perforation is formed between the limiting block and the substrate, one side of the limiting block, close to the retaining rod, is formed with a limiting groove, a shaft is inserted in the through hole and the perforation, and one end of the shaft, close to the limiting block, extends outwardly and is pivotally connected to a pivot plate through a pivot member;

wherein the pivot plate has a driving portion and a driven portion that are perpendicular to each other, the driving portion of the pivot plate is close to the retaining rod to be blocked by the retaining rod, a free end of the driving portion of the pivot plate is connected to a handle, a free end of the driven portion of the pivot plate is pivotally connected to a pivot wheel, the pivot wheel is movably disposed in the limiting groove, another end of the shaft, opposite to the handle, extends out of the substrate and is pivotally connected to the rotating member, and the shaft is sleeved with an elastic member between the cover plate and the rotating member.

2. The oscillating device of the belt sander as claimed in claim 1, wherein the motor is provided with a transmission shaft, and one end of the transmission shaft is connected to the roller.

3. The oscillating device of the belt sander as claimed in claim 1, wherein the shaft is connected to the frame, the frame has a first end and an opposing second end, the first end is provided with a first rotating shaft, the second end is provided with a second rotating shaft, and the first rotating shaft and the second rotating shaft are insertedly connected to the rolling wheel.

4. The oscillating device of the belt sander as claimed in claim 3, wherein the rotating member further includes an adjusting member, the adjusting member includes a screw cap, an adjusting rod and a positioning block, the adjusting rod is disposed between the screw cap and the positioning block, and the positioning block is connected to the first rotating shaft.

5. The oscillating device of the belt sander as claimed in claim 3, wherein the electric motor is electrically connected to a sensor, a positioning magnet is provided below the sensor, a transmission shaft of the electric motor is connected to a linking shaft through a deceleration mechanism, a free end of the linking shaft is formed with a receiving groove, the linking shaft is connected to the linking member, the linking member has a receiving hole and an axial hole that are spaced apart from each other, the free end of the linking shaft is located in the receiving hole and sleeved with an eccentric wheel, the linking shaft and the eccentric wheel are arranged eccentrically, the eccentric wheel has an accommodating groove corresponding to the receiving groove, a pin is inserted in the receiving groove and the accommodating groove, the eccentric wheel is sleeved with a bearing, the bearing and the eccentric wheel are disposed in the receiving hole, the bearing, the eccentric wheel and the receiving hole are arranged concentrically, an eccentric shaft passes through the axial hole, and the eccentric shaft is connected to the second end of the frame.

6. The oscillating device of the belt sander as claimed in claim 1, further comprising an angle adjustment unit, the angle adjustment unit including an angle adjustment member, an angle adjustment handle being provided on one side of the angle adjustment member, another side of the angle adjustment member being connected to one end of a connecting rod, the connecting rod being sleeved with a detecting member and a scale ring, the detecting member having a recess for detecting a rotation angle of the scale ring, another end of the connecting rod having a threaded portion, an adjusting plate being connected to the threaded portion, the adjusting plate having a toothed portion corresponding to the threaded portion, the toothed portion being engaged with the threaded portion, one end of the adjusting plate, opposite to the toothed portion, being secured to the substrate.

7. The oscillating device of the belt sander as claimed in claim 6, further comprising a control unit, the control unit having a panel, a knob and a switch, the panel being configured to display an angle value generated by the angle adjustment unit, the knob being configured to adjust a speed of the electric motor, the switch being configured to turn on/off the belt sander, the control unit including a start switch detection module and a sensor detection module.

8. The oscillating device of the belt sander as claimed in claim 1, further comprising a forward and backward adjustment unit, the forward and backward adjustment unit including a retaining seat, the retaining seat parallel to the workbench being threadedly connected with one end of a screw rod and two positioning posts, another end of the screw rod extending outwardly and being inserted through a limiting member of the workbench, the free end of the screw rod being connected to a forward and backward adjustment knob, two ends of the positioning posts being secured to the workbench, respectively.

9. The oscillating device of the belt sander as claimed in claim 1, further comprising an upward and downward adjustment unit, the upward and downward adjustment unit including a lifting plate, a top of the lifting plate being provided with an upward and downward adjustment block and two retaining posts, the upward and downward adjustment block having an internal thread for engagement of a threaded section of a lifting rod, the lifting rod being connected with a first gear, the first gear being meshed with a second gear, the second gear being perpendicular to the first gear, the second gear being connected with a rotating member, the rotating member being provided with a handle, one end of each retaining post, opposite to the lifting plate, being secured to the workbench.

* * * * *